US010169943B2

(12) United States Patent
Canter et al.

(10) Patent No.: US 10,169,943 B2
(45) Date of Patent: Jan. 1, 2019

(54) HAPTIC FEEDBACK APPARATUS AND METHOD FOR AN ELECTION VOTING SYSTEM

(71) Applicant: Hart InterCivic Inc., Austin, TX (US)

(72) Inventors: James M. Canter, Austin, TX (US); Drew E. Tinney, Austin, TX (US)

(73) Assignee: Hart InterCivic, Inc., Austin, TX (US)

( * ) Notice: Subject to any disclaimer, the term of this patent is extended or adjusted under 35 U.S.C. 154(b) by 5 days.

(21) Appl. No.: 15/479,665

(22) Filed: Apr. 5, 2017

(65) Prior Publication Data

US 2018/0293829 A1 Oct. 11, 2018

(51) Int. Cl.
*G07C 13/02* (2006.01)

(52) U.S. Cl.
CPC ..... *G07C 13/02* (2013.01); *G06Q 2230/00* (2013.01)

(58) Field of Classification Search
CPC ..... G06Q 2230/00; G07C 13/02
USPC ..... 235/386
See application file for complete search history.

(56) References Cited

U.S. PATENT DOCUMENTS 5,585,612 A 12/1996 Harp
5,742,278 A 4/1998 Chen et al.
5,821,508 A 10/1998 Willard
6,639,510 B1 10/2003 Soulie
6,732,918 B2 * 5/2004 Coventry ..... G07F 19/20 235/379
6,951,303 B2 10/2005 Peterson et al.
7,134,597 B1 * 11/2006 Jones ..... G07C 13/00 235/386
7,344,071 B2 3/2008 Cummings et al.
8,059,105 B2 11/2011 Rosenberg et al.
8,905,306 B2 12/2014 Hotto et al.
(Continued)

FOREIGN PATENT DOCUMENTS

JP 2002230609 8/2002
JP 2003109058 4/2003
JP 2003208648 7/2003
WO 89/06848 7/1989
WO 2016/108780 7/2016
WO 2016/165024 10/2016

OTHER PUBLICATIONS

Burton et al., "The Ballot Ballet: The Usability of Accessible Voting Machines", AFB AccessWorld Magazine (Jul. 2004), 8 pp.
(Continued)

*Primary Examiner* — Toan Ly
(74) *Attorney, Agent, or Firm* — Egan Peterman Enders Huston

(57) ABSTRACT

A voting system provides haptic feedback to a visually impaired voter to guide the voter. The haptic feedback may include vibration. The vibration may provide guidance by vibrating tactile written instructions, such as braille. The vibration may also provide guidance to the voter via the location of the vibration. A particular tactile instruction may be selectively highlighted at the appropriate time in the voting process and/or appropriate location on the voting device. In this manner, haptic guidance and cues are provided to a visually impaired voter. In one embodiment, the haptic feedback is provided by vibrating a relevant braille instruction at the relevant time during the voting process. In this manner touch sense guidance and cues are provided to a voter to emphasize what braille instructions are currently relevant to a voter and/or the location of such relevance.

21 Claims, 3 Drawing Sheets

(56) References Cited

U.S. PATENT DOCUMENTS

| | | | | |
|---|---|---|---|---|
| 8,949,745 | B2 | 2/2015 | Yu et al. | |
| 8,985,435 | B2 | 3/2015 | Canter et al. | |
| 9,240,129 | B1 * | 1/2016 | Niemann | G09B 21/003 |
| 2003/0178484 | A1 | 9/2003 | Vadura et al. | |
| 2005/0035199 | A1 | 2/2005 | Goci et al. | |
| 2010/0019036 | A1 | 1/2010 | Hawkins et al. | |
| 2010/0198200 | A1 | 8/2010 | Horvath | |
| 2011/0111375 | A1 | 5/2011 | Luu et al. | |
| 2012/0070805 | A1 | 3/2012 | Wong et al. | |
| 2013/0095454 | A1 | 4/2013 | Jwa | |
| 2013/0157230 | A1 | 6/2013 | Morgan | |
| 2014/0052505 | A1 | 2/2014 | Canter et al. | |
| 2014/0231513 | A1 * | 8/2014 | Brockhouse | G07C 13/02 235/386 |
| 2015/0262509 | A1 | 9/2015 | Labbe et al. | |

OTHER PUBLICATIONS

Jayant et al., "VBraille: Haptic Braille Perception using a Touch-screen and Vibration on Mobile Phones," Computer Science and Engineering Department at University of Washington in Seattle USA (Oct. 25-27, 2010), 2 pp.

Damian Koh, "Vibrating touch screen enable Braille reading", CNET (Apr. 6, 2009), 4 pp.

Anil Ananthaswamy, "Vibrating touch screen puts Braille at the fingertips", New Scientist (Mar. 25, 2009), https://www.newscientist.com/article/mg20127015.700-vibrating-touch-screen-puts-braille-at-the-fingertips/, 1 page.

Christophe Ramstein, "Combining Haptic and Braille Technologies: Design Issues and Pilot Study", Center for Information Technologies Innovation, CHI 96 Electronic Proceedings (Apr. 15, 1996), 12 pp.

* cited by examiner

HAPTIC FEEDBACK APPARATUS AND METHOD FOR AN ELECTION VOTING SYSTEM

BACKGROUND OF THE INVENTION

This application expressly incorporates by reference, in its entirety, U.S. Pat. No. 8,985,435.

The present disclosure relates to the voting systems for elections. More specifically, it provides a system and method for providing haptic feedback to a voter.

A variety of electronic and paper voting systems are well known. One feature of modern voting systems is voter accessibility. Various federal, state and local authorities require election polling sites and equipment to be accessible to all voters. As part of voter accessibility, voting systems should accessible to visually impaired voters. Various mechanisms are known to provide accessibility to visually impaired voters, including the provision of braille instructions and audio instructions to visually impaired voters. However, it is desirable to provide an improved voting experience for visually impaired voters, including providing a visually impaired voter a voting process that requires less intervention and assistance from polling station officials.

SUMMARY OF THE INVENTION

In one embodiment, the present disclosure describes providing haptic feedback to a visually impaired voter to give guidance to the voter. More particularly, the haptic feedback may include vibration. In one embodiment, the vibration may provide guidance by vibrating tactile written instructions, such as braille. The vibration may also provide guidance to the voter via the location of the vibration. In one embodiment, a particular tactile instruction may be selectively highlighted at the appropriate time and location at the voting device. In this manner, haptic cues are provided to a visually impaired voter. In one embodiment, the haptic feedback is provided by vibrating a relevant braille instruction at the relevant time during the voting process. Thus, vibrating guidance and cues are provided to a voter that is visually impaired. In this manner, touch sense guidance and cues are provided to a voter to emphasize what braille instructions are currently relevant to a voter and the location of such relevance.

In another embodiment, the present disclosure provides an election voting device. The election voting device may comprise a tactile plate located on, or as part of, a surface of the election voting device, the tactile plate being located in a manner to allow touching by a voter during use of the election voting device. The election voting device may further comprise a mechanical vibrator located proximate to the tactile plate so that the tactile plate may vibrate in response to vibrations of the mechanical vibrator. In one embodiment, the tactile plate may include tactile conveyed writing, such as for example, braille. In one embodiment, the mechanical vibrator is a vibrating motor controlled by the election voting device. In one embodiment, the tactile plate is detachable from the mechanical vibrator. In one embodiment, the tactile plate is detachable from the election voting device. In one embodiment, the tactile plate includes tactile conveyed written instructions related to use of the election voting device during a voting process. In one embodiment, the tactile plate is provided in a location such that the location of the tactile plate provides information to a voter. In one embodiment, the tactile plate is located proximate to a ballot insertion location of the election voting device. In one embodiment, the tactile plate has braille that provides instructions related to a status of the election voting device, the status related to ballot insertion.

In yet another embodiment, a method of providing information to a visually impaired voter during an election voting process is disclosed. The method may comprise providing an election voting device and providing guidance regarding the voting process to the visually impaired voter by vibrating a tactile plate. In one embodiment, the guidance regarding the voting process may include tactile written instructions on the tactile plate, such as for example, braille. In one embodiment, the guidance regarding the voting process may include guidance as to a relevant location on the election voting device. In one embodiment, the location on the voting device may be a ballot insertion location of the election voting device.

BRIEF DESCRIPTION OF THE DRAWINGS

A more complete understanding of the present invention and advantages thereof may be acquired by referring to the following description taken in conjunction with the accompanying drawings, in which like reference numbers indicate like features. It is to be noted, however, that the accompanying drawings illustrate only exemplary embodiments of the disclosed concept and are therefore not to be considered limiting of its scope, for the disclosed concept may admit to other equally effective embodiments.

DESCRIPTION OF THE PREFERRED EMBODIMENTS

The present disclosure provides an improved haptic feedback experience for a visually impaired voter. A typical voting process requires providing a voter a wide range of instructions at a polling station or booth. For example, at a polling station instructions may be provided to a voter to instruct the voter to submit an identification number or code, submit jurisdiction information, submit ballot information, select a particular race, select a particular voting choice, select another race, print a ballot, insert a ballot into ballot processing unit, etc. The instructions provided to a voter at a polling station are wide ranging and also vary widely from voting system to voting system and jurisdiction to jurisdiction. In addition, typically the voting process must be performed in a prescribed order. Typically a voter is guided through these actions via visually cues such as text, lights, color coding, etc.

The visually impaired voter may be assisted through the voting process via a tactile writing system such as braille. However, merely providing braille instructions fails to create the same experience as perceived by a visually enabled voter. For example, the sequential nature of displaying instructions only when relevant is lost. Further, the ability to highlight when and where an action is to occur on a voting device is less than satisfactory when visual cues are not accessible.

As described herein, additional haptic feedback is provided to a visually impaired voter to highlight a particularly tactile instruction. Thus, a particular tactile instruction may be selectively highlighted at the appropriate time and location at the voting device. In this manner, haptic guidance and cues are provided to a visually impaired voter. In one embodiment, the haptic feedback is provided by vibrating a relevant braille instruction at the relevant time during the voting process. Thus, vibrating guidance and cues are provided to a voter that is visually impaired. In this manner touch sense guidance and cues are provided to a voter to emphasize what braille instructions are currently relevant to a voter and the location of such relevance.

Figure 1:
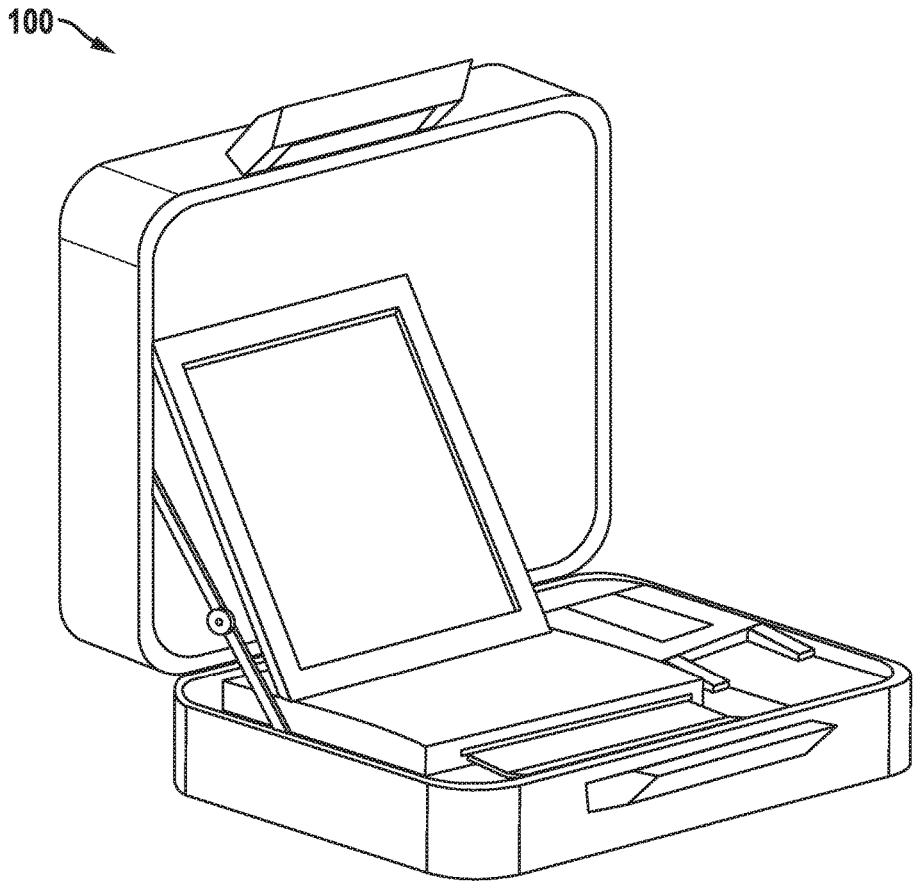
FIG. 1 illustrates an exemplary voting device.
Figure 2:
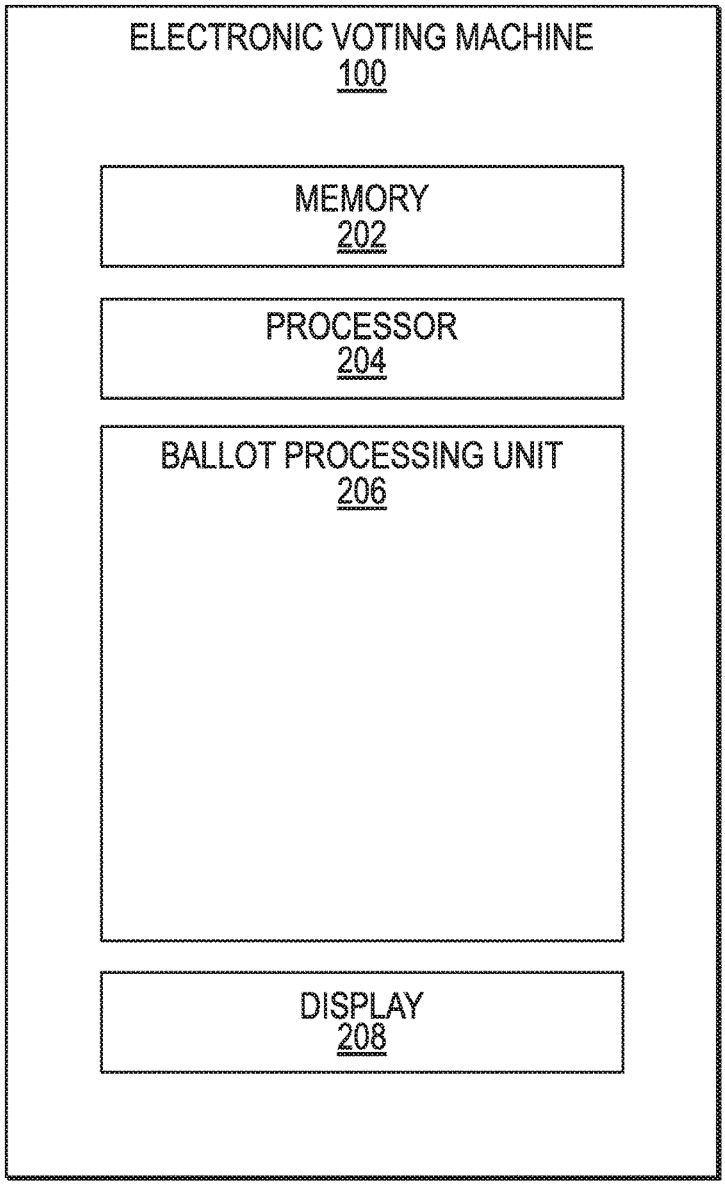
FIG. 2 illustrates an exemplary configuration of a voting device.

FIG. 1 illustrates an exemplary voting device 100, such as disclosed in U.S. Pat. No. 8,985,435, the disclosure of which is incorporated herein in its entirety by reference. As shown in FIG. 2, the voting device 100 may include a memory 202, a processor 204. Though shown as a processor, processor 204 may alternatively be a microcontroller, programmable logic device or other data processing structure that may be used in a voting device. In one embodiment, the processor, microcontroller or programmable logic device may be configured to execute instructions or configuration files to perform the functions described herein. The voting device may further include a ballot processing unit 206 and a display 208 which may typically be used by visually enabled voters. It will be recognized that the voting device 100 of FIGS. 1 and 2 is merely exemplary. Thus, it will be recognized by those skilled in the art that the techniques disclosed herein may be utilized in any of a wide range of voting devices that are utilized during the voting process and the techniques are not limited to the voting device 100. In addition, the ballot processing unit 206 may take one of many forms to provide one or more of many ballot processing functions, such as providing mechanisms for entering information, mechanisms for selecting ballot choices, mechanisms for printing ballots, mechanisms for inserting of ballots, mechanisms for casting ballots, etc., all dependent upon the type of voting device and the particular voting process of a jurisdiction.

Figure 3:
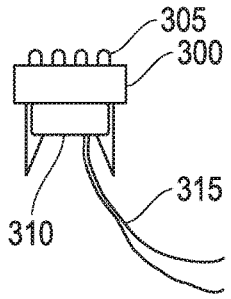
FIG. 3 illustrates an exemplary tactile plate and mechanical vibrator.

At various places on the voting device 100, tactile writing system instructions, such as braille characters, may be provided for use by the visually impaired voter. As shown in FIG. 3, tactile plate 300 may contain a cell of braille instructions which provided the tactilely perceptible raised dots 305 comprising braille characters. A voting device utilizing the techniques described herein may be configured to have tactile plate 300 placed on the voting device. The placement of tactile plate 300 may occur at one or more locations on the voting device, again dependent upon the particular voting device and voting process. Adjacent the tactile plate 300 is a mechanical vibrator 310. In one exemplary embodiment, mechanical vibrator 310 may be a vibrating motor. The mechanical vibrator 310 provides vibration to one or more particular braille instructions. By vibrating selected braille instructions, the selected braille instruction(s) may be highlighted to a visually impaired voter. Thus, for example, at the point in time a particular instruction is relevant, the visually impaired voter may be able to detect that particular instruction due to the vibrations that accompany the particular braille instruction. The vibrations can alternatively, provide indication to a voter where on a voting machine some action is to occur. Thus, the vibrations may help guide the visually impaired voter to the appropriate location that some action is to occur, for example where a ballot is to be placed, where a button is to be pushed, or any other of a wide range of location specific instructions. Further, the vibration can both provide a time and location indication to a visually impaired voter. Thus, the vibration may highlight both when and where a particular braille instruction is relevant.

Control wiring 315 may be provided to the mechanical vibrator 310. The control wiring 315 may provide signals to the mechanical vibrator 310 so as to activate the vibration. The signals may be provided from other computer, processing or control components of the voting device 100, such as for example, the processor 204. The signals on the control wiring provide the appropriate control of the mechanical vibrator 310 so that based upon the state of the voting process, vibration is provided to the proper tactile plate 300 of the voting device 100.

As described above, braille instructions may be provided at various locations on the voting device 100. Some or all of these instructions may be configured in a manner such as shown in FIG. 3 so that the braille instructions may vibrate. The tactile plate 300 (and its raised dots 305), may be formed as an integral unit with mechanical vibrator 310. A voting device 100 may be constructed in a manner that the integral tactile plate 300 and mechanical vibrator 310 may be "snapped" in place at the appropriate locations on the voting device 100 in which braille instructions are desired. In such cases, a wiring connector may also be provided on the voting device to connect the control wiring 315. In other embodiments, the tactile plate 300 and the mechanical vibrator may be separate connectable structures. Thus, for example, a voting device may be constructed with a mechanical vibrator 310 already in place, and then the tactile plate 300 may be a separate connectable plate that may be "snapped" on to the mechanical vibrator structure or the voting device in a location adjacent the mechanical vibrator 310. In this manner, the braille instructions may be interchangeable without having to interchange the mechanical vibrator. Thus, for example, if different voting jurisdictions require differing wording for instructions, the braille plates may be formed for that particular jurisdiction and attached to the voting devices used in that jurisdiction. Further, if not used, the braille instructions may be merely replaced with blank tactile plates. Thus, in some embodiments, the tactile plate may not even have braille instructions, yet still be used as a haptic cue for a particular location on a voting device. In this embodiment, mere vibration of a blank tactile plate may be sufficient to guide the visually impaired voter to the appropriate location on the voting device. In such case, the vibration only may provide an indication of the state of the machine. Thus, for example, vibration may indicate the voting is ready for some particular action and no vibration may indicate the voting device is not ready for that action. Alternatively, the vibration of the blank tactile plate may highlight where an action is to occur.

Though the tactile plate 300 is shown in FIG. 3 in the context of a plate that would be separate from the surface of a voting device, the tactile plate need not be separate. Thus, as used herein, the tactile plate may be constructed as part of the some exterior surface of the voting device. Thus, the tactile plate may be formed as being a portion of a surface of the voting device in which a corresponding mechanical vibrator may be located in proximity. Thus, the tactile plate may be molded integrally into a surface of the voting device, the relevant portion of the voting device surface being considered the tactile plate.

In this manner a vibrating tactile writing system, such as a vibrating braille system, may be used to provide haptic feedback to a visually impaired voter as to what particular tactile instruction is relevant at a particular time and/or where on a voting device the particular instruction is most relevant.

In order to provide an example usage of the techniques described herein, usage of the technique for a particular instruction will be described below. It will be recognized by those skilled in the art that this particular instruction is merely exemplary. Thus, the techniques provided herein may be utilized with other instructions and at other locations on a voting device, all as would be recognized by those skilled in the art.

Figure 4:
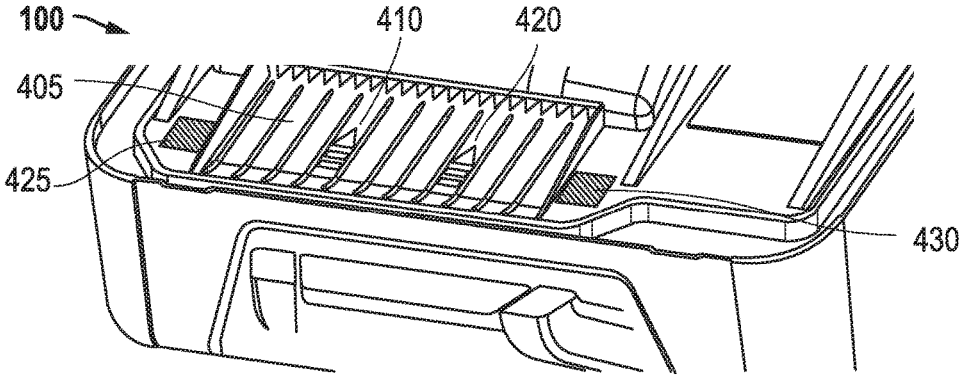
FIG. 4 illustrates an exemplary voting device having an exemplary use of tactile plates that may vibrate.

As shown in FIG. 4, an exemplary voting device 100 may have a ballot receiving tray 405. The ballot receiving tray 405 may be utilized for insertion of a voter's ballot that is to be processed by the voting device 100. Typically, the voting device is configured to accept the voter's ballot only at predetermined times during the voting process. Thus, as described in U.S. Pat. No. 8,985,435, indications may be provided to a voter as to when the voting device 100 is ready to receive a ballot. As described in that patent, green or red "landing lights" 410 and 420 are provided so that a visually enabled voter may know when a ballot can be inserted (green lights) and when a ballot should not be inserted (red lights). In addition, a display screen may also provide guidance to a visually enabled voter with instructions indicating when a ballot may be inserted. However, such techniques do not aid the visually impaired voter. According to the techniques disclosed herein, corresponding instructions may be provided to the visually impaired voter through the use of vibrating plates 425 and/or 430. For example, vibrating plate 425 may contain the instruction "INSERT SHEET" and vibrating plate 430 may contain the instruction "PLEASE WAIT." When the voting device 100 is ready for a ballot to be inserted into the receiving tray 405, the vibrating plate 425 may begin vibrating. This vibration will alert the visually impaired voter that the "INSERT SHEET" instruction is now applicable and also provide some guidance on the machine as to generally where the action is to take place. At times when the voting device 100 is not ready for insertion of a ballot, the vibrating plate 430 may be vibrating, thus highlighting the please wait instruction to the voter. In this manner, haptic feedback is provided to a visually impaired voter to highlight that a particular braille instruction is now relevant. As mentioned, this exemplary instruction is not meant to be limiting and many other types of voting instructions may utilize the technique of vibrating a braille instruction in order to highlight the relevant time and/or location for that instruction.

As discussed above, it will be recognized that the instructions and locations described above with regard to FIG. 4 are merely exemplary. Thus, the vibrational haptic feedback described herein may occur on differing locations of a voting device and may correspond to touch cues for differing messages to be provided to the visually impaired voter. As will be recognized a wide range of instructions may be provided with a corresponding vibrating cue, such as for example, "ballot cast," "ballot may be incorrectly marked," "ballot scanning error," "voting is complete," and any other potential voting instructions. Further, as mentioned above, the touch cue may merely be the vibration itself without any corresponding instructions provided on the vibrating tactile plate (for example a "blank" or smooth tactile plate).

Other features may also be optionally incorporated into the vibrating touch cue techniques disclosed herein. For example, in one embodiment, the vibrating plate may be combined with a touch sensor. In such a case, the touch sensor may indicate when a visually impaired voter is touching the tactile plate. In this embodiment, the vibration may be limited to only when a touch is detected. Thus, for battery powered systems, power may be conserved so that needless vibration is not provided when the plate is not being touched. In addition, the haptic techniques described herein may be utilized in combination with other accessibility features. For example, the vibrating cues may be utilized in conjunction with audio cues, thus providing a multimedia presentation to the visually impaired voter. In one example, the audio instructions may be synchronized with the vibrational cues. One such embodiment may include audio instructions to perform an operation at the location of the vibrating plate. For example, with regard to the example of FIG. 4, audio instructions may indicate that the ballot should be inserted into the receiving tray immediately adjacent to the vibrating plate or in the receiving tray between the two vibrating plates (in this later example, both tactile plates may vibrate together to cue the voter where the ballot should be inserted). As will be recognized by those in the art, the combinations of instructions and cues may be wide ranging.

Though the embodiments shown herein are described with regard to an exemplary voting device, as used herein "voting device" is meant to encompass any device utilized in a voting process. Thus, the voting device may be a device in which a voter enters voter information, a voter provides voting choices, a voter casts ballots, a voter prints ballots, a voter submits ballots, etc. Further, a voting device may be any peripheral connected devices utilized at a voting location such as scanners, printers, accessibility interfaces, ballot receptacles, storage devices, etc. Further, a voting device may be a device utilized to control or operate a polling location such as computers, network controllers, storage devices, etc. In this manner, it will be recognized that a voting device may be any device or equipment in which a visually impaired person may interact with during the voting process, whether the person is a voter or an election official.

Though described herein with respect to voting devices and equipment, it will be recognized that the concepts described herein may be utilized with regard to other devices or equipment. Thus, the concepts described herein may be adapted to any of a wide range of devices or equipment in which a visually impaired person needs to interact with. Further, the concepts described herein may provide a particular benefit when the visually impaired person's interaction with the equipment requires instructions to be provided to the visually impaired person at particular times or in a particular order. Further, the concepts described herein may provide a particular benefit when the visually impaired person's interaction with the equipment requires an interaction at a particular location on the equipment. In this manner, it will be recognized that the techniques described herein are not limited to usages in voting devices but can be extended to a wide range of devices and equipment, all of which would be recognized to those skilled in providing accessibility to the visually impaired after having the benefit of review of the techniques described herein.

Further modifications and alternative embodiments of this invention will be apparent to those skilled in the art in view of this description. Accordingly, this description is to be construed as illustrative only and is for the purpose of teaching those skilled in the art the manner of carrying out the invention. It is to be understood that the forms and methods of the invention herein shown and described are to be taken as presently preferred embodiments. Equivalent techniques may be substituted for those illustrated and describe herein and certain features of the invention may be utilized independently of the use of other features, all as would be apparent to one skilled in the art after having the benefit of this description of the invention.

What is claimed is:

1. An election voting device, comprising:

a tactile plate located on, or as part of, a surface of the election voting device, the tactile plate being located in a manner to allow touching by a voter during use of the election voting device; and a mechanical vibrator located proximate to the tactile plate so that the tactile plate may vibrate in response to vibrations of the mechanical vibrator, wherein the tactile plate is detachable from the mechanical vibrator or detachable from the election voting device.

2. The election voting device of claim 1, wherein the tactile plate includes tactile conveyed writing.

3. The election voting device of claim 2, wherein the mechanical vibrator is a vibrating motor controlled by the election voting device.

4. The election voting device of claim 2, wherein the tactile plate is detachable from the mechanical vibrator.

5. The election voting device of claim 2, wherein the tactile plate is detachable from the election voting device.

6. The election voting device of claim 2, wherein the tactile plate includes braille.

7. The election voting device of claim 1, wherein the tactile plate includes tactile conveyed written instructions related to use of the election voting device during a voting process.

8. The election voting device of claim 1, wherein the tactile plate is provided in a location such that the location of the tactile plate is configured to provide information to a voter.

9. The election voting device of claim 1, wherein the tactile plate is located proximate to a ballot insertion location of the election voting device.

10. The election voting device of claim 9, wherein the tactile plate has braille that provides instructions related to a status of the voting device, the status related to ballot insertion.

11. The election voting device of claim 1, the tactile plate has braille that provides instructions related to a status of the voting device, the status related to ballot insertion.

12. The election voting device of claim 1, wherein the mechanical vibrator is a vibrating motor controlled by the voting device.

13. The election voting device of claim 1, wherein the tactile plate is detachable from the mechanical vibrator.

14. The election voting device of claim 1, wherein the tactile plate is detachable from the election voting device.

15. A method of providing information to a visually impaired voter during an election voting process, comprising:

providing an election voting device; and providing guidance regarding the voting process to the visually impaired voter by vibrating a tactile plate, wherein the tactile plate is detachable from a mechanical vibrator or detachable from the election voting device.

16. The method of claim 15, the guidance regarding the voting process including tactile written instructions on the tactile plate.

17. The method of claim 16, the tactile written instructions being braille instructions.

18. The method of claim 17, the guidance regarding the voting process including guidance as to a location on the election voting device.

19. The method of claim 18, the location on the election voting device being a ballot insertion location of the voting device.

20. The method of claim 15, the guidance regarding the voting process including guidance as to a location on the election voting device.

21. The method of claim 20, the location on the election voting device being a ballot insertion location of the election voting device.

* * * * *